US005154191A

United States Patent [19]

Owens, Jr.

[11] Patent Number: 5,154,191

[45] Date of Patent: Oct. 13, 1992

[54] WRAPPERS FOR SMOKING ARTICLES, METHODS OF MAKING SUCH WRAPPERS AND SMOKING ARTICLES MADE FROM SUCH WRAPPERS - CASE I

[75] Inventor: William F. Owens, Jr., Pisgal Forest, N.C.

[73] Assignee: P. H. Glatfelter Company, Spring Grove, Pa.

[21] Appl. No.: 514,533

[22] Filed: Apr. 26, 1990

[51] Int. Cl.[5] ..... A24F 1/02

[52] U.S. Cl. ..... 131/365; 131/335

[58] Field of Search ..... 131/365, 335

[56] References Cited

U.S. PATENT DOCUMENTS

| | | | |
|---|---|---|---|
| 2,886,042 | 5/1959 | Hoover | 131/276 |
| 3,744,496 | 7/1973 | McCarty et al. . | |
| 4,231,377 | 11/1980 | Cline et al. . | |
| 4,236,532 | 12/1980 | Schwerzer et al. | 131/365 |
| 4,450,847 | 5/1984 | Owens | 131/365 |
| 4,461,311 | 7/1984 | Mathews et al. . | |
| 4,804,002 | 2/1989 | Herron | 131/276 |
| 4,805,644 | 2/1989 | Hampl, Jr. et al. . | |
| 4,881,557 | 11/1989 | Martin . | |
| 4,915,118 | 4/1990 | Kaufman et al. . | |

FOREIGN PATENT DOCUMENTS

| | | | |
|---|---|---|---|
| 0175148 | 6/1953 | Austria | 131/365 |
| 0804351 | 1/1969 | Canada | 131/365 |

OTHER PUBLICATIONS

*Tobacco Flavoring for Smoking Products*, by Leffingwell et al., Published by R. J. Reynolds Tobacco, 1972, pp. 11-14 Cited Winston Salem, N.C.

*Primary Examiner*—V. Millin

*Attorney, Agent, or Firm*—Kerkam, Stowell, Kondracki & Clarke

[57] ABSTRACT

A wrapper for smoking articles comprises a cellulosic sheet with filler concentrations in said sheet in the range of 14 to 60 g/m$^2$ and an acid coated on at least the inner surface of the sheet.

12 Claims, No Drawings

WRAPPERS FOR SMOKING ARTICLES, METHODS OF MAKING SUCH WRAPPERS AND SMOKING ARTICLES MADE FROM SUCH WRAPPERS - CASE I

SUMMARY OF THE INVENTION

This invention relates to improved wrappers for smoking articles, the method of making such wrappers, and to smoking articles made from such wrappers.

The purpose of this invention is to provide improved subjective taste properties to cigarettes wrapped in reduced sidestream smoke cigarette papers. Such papers have good appearance and high opacity which, when fabricated into cigarettes with suitable tobacco columns, statically burn at acceptable rates and produce up to 75% less particulate sidestream smoke than do cigarettes fabricated with conventional cigarette papers. More specifically, these desirable improvements in subjective properties of reduced sidestream smoke cigarettes are accomplished by treating the reduced sidestream smoke cigarette paper with relatively low levels of organic acids. The acid treatment can be used with burning chemicals and/or thermally stable ash conditioners to effect ash improvements.

BACKGROUND OF THE INVENTION

The reduced cigarette sidestream smoke papers or wrappers, as described in U.S. Pat. No. 4,231,377 Cline et al.; U.S. Pat. No. 4,420,002 Cline; U.S. Pat. No. 4,433,697 Cline et al.; U.S. Pat. No. 4,450,847 Owens; and U.S. Pat. No. 4,881,557 Martin use high levels of basic fillers ($MgO/Mg(OH)_2$ and $CaCO_3$) to achieve reductions in the sidestream smoke of cigarettes. The filler concentrations in these papers are typically in the range of 14 to 60 grams per square meter, which is significantly higher than the 6 to 9 grams per square meter in regular cigarette paper. The high basis weights of these reduced cigarette sidestream smoke papers (typically 35 to 75 $g/m^2$) and the resultant thickness increase, along with the "heat sink" effect caused by the thermal breakdown of magnesium hydroxide (shown in equation 1 below), causes an increased condensation of the smoke on the inside surface of the paper and within the paper structure itself. This smoke normally would penetrate through regular cigarette paper and form the typical sidestream smoke plume observed with regular cigarettes.

Equation 1

$$Mg(OH)_2 \xrightarrow[350^\circ C.]{Heat} MgO + H_2O \quad \Delta H = +332 \text{ calories/gram}$$

Extensive subjective taste studies have shown the taste characteristics of cigarettes wrapped in reduced cigarette sidestream smoke papers to have objectionable taste characteristics relative to regular cigarettes. Additional studies have also shown the pH of the mainstream smoke of tobacco columns wrapped in reduced sidestream smoke cigarette paper is higher than that of the same tobacco columns wrapped in regular cigarette paper. The subjective taste characteristics of cigarettes wrapped in reduced sidestream smoke cigarette paper are similar to that obtained when the pH of mainstream smoke of regular cigarettes is artificially increased.

The increased tar condensation on the inside surface of the cigarette paper and in the internal structure of the cigarette paper itself, along with the significantly higher level of basic fillers [MgO, $Mg(OH)_2$, and $CaCO_3$) in the reduced cigarette sidestream smoke papers, results in a greater reaction of acidic smoke components with the basic fillers in the reduced sidestream smoke papers versus regular cigarette papers. This reaction results in nonvolatile tar components being formed which are not revolatilized back into the mainstream smoke but are pyrolyzed to lower molecular weight smoke components.

DETAILED DESCRIPTION OF THE INVENTION

It has been found that either (1) coating of the inner surface of the reduced sidestream smoke cigarette paper by a typical gravure printing process using anhydrous solvents, such as anhydrous isopropyl alcohol, in which are dissolved organic acids or (2) treatment of the entire reduced sidestream smoke cigarette paper with aqueous or anhydrous solutions of organic acids results in a paper which, when used to make cigarettes, gives desirable subjective taste properties approaching that obtained with cigarettes wrapped with regular cigarette paper. Regular cigarette paper may be defined as a paper made from seed flax having a total basis weight of about 25 $g/m^2$, of which 30% comprises $CaCO_3$ and 0.5% to 1% sodium potassium citrate burning chemical. The optimum level of acid in the sheet applied in (1) above is in the range of 0.25% to 4.0%. The optimum level of acid applied in (2) above is 0.5% to 5.0%. The acids which have been found to be most effective in achieving the desired taste improvements are selected from the group of citric, malic, lactic, glycolic, tartaric, fumaric, maleic, malonic, glutaric, adipic and succinic. Other acids may also give positive results, and the above are only intended to illustrate the invention. Some acids, such as acetic, give positive taste improvements but are not long lasting, as would be desirable for use in cigarette production.

Studies conducted to date would indicate the acid application to the paper results in deactivation of the surface of the reduced sidestream smoke cigarette paper towards acidic smoke tar components. This deactivation is most likely caused by the reaction of the highly basic fillers with the acid coating applied, either by a printing operation or as a total sheet sizing.

TABLE I

| EXAMPLES | | | | | | | | |
|---|---|---|---|---|---|---|---|---|
| Sample No. | Basis Weight $g/m^2$ | Flax Fiber % | Filler % $Mg(OH)_2$ | Filler % $CaCO_3$ | Burning Chemical | % Alkali Metal | Treatment Acid-Method | % Acid |
| 1 | 45 | 60 | 5 | 25 | KOAC | 2.0 | None | None |
| 2 | " | " | " | " | " | " | Citric-Printed | 0.83 |
| 3 | " | " | " | " | " | " | Malic-Printed | 0.80 |
| 4 | " | " | " | " | " | " | Citric-Size Press | 1.38 |
| 5 | " | " | " | " | " | " | Malic-Size Press | 1.42 |
| 6 | " | " | " | " | " | 6.0 | Citric-Printed | 0.82 |
| 7 | " | " | " | " | KCl | 6.0 | Malic-Size Press | 1.40 |

TABLE I-continued

| Sample No. | Basis Weight g/m² | Flax Fiber % | Filler % Mg(OH)₂ | Filler % CaCO₃ | Burning Chemical | % Alkali Metal | Treatment Acid-Method | % Acid |
|---|---|---|---|---|---|---|---|---|
| | | | EXAMPLES | | | | | |
| 8 | " | " | " | " | " | 2.0 | Malic-Size Press | 5.28 |
| 9 | 25 | 70 | 0 | 30 | K Citrate | 0.31 | None | None |

The subjective taste properties of cigarettes made with papers 2 to 8 were compared to cigarettes made from sample 1. Cigarettes made from papers 2 to 7 all gave similar taste responses as compared to 1-milder, smoother, less astringent with no mouth coating/after-taste. At the acid treatment levels given for samples 2 to 7, the off-taste versus sample 9 (regular cigarette paper) was reported to be minimal, if any, and were considered to have acceptable taste properties. Taste of cigarettes made from sample 1 versus sample 9 was considered to be harsh, bitter, and astringent with an unacceptable mouth coating/lingering after-taste. The taste of cigarettes made from sample 8 versus sample 9 was described as harsh, peppery, and more astringent-indicating the acid treatment level was too high for sample 8-although the mouth coating/after-taste properties were reported to be improved over the obtained from sample 1.

I claim:

1. A wrapper for smoking articles, comprising a cellulosic sheet, basic filler concentrations in said sheet in the range of 14 to 60 g/m², and an acid coated on at least the inner surface of the sheet so as to form neutral salts on the surface of the filler particles.

2. The wrapper, as defined in claim 1, wherein the acid is selected from the group consisting of citric, malic, lactic, glycolic, tartaric, fumaric, maleic, malonic, glutaric, adipic, and succinic acid.

3. The wrapper, as defined in claim 2, wherein the acid is applied by a printing process and the acid is dissolved in an anhydrous solvent.

4. The wrapper, as defined in claim 2, wherein the acid is applied from a solution thereof.

5. A smoking article comprising a tobacco charge and a wrapper for the tobacco charge, said wrapper comprising a cellulosic sheet, basic filler concentrations in said sheet in the range of 14 to 60 gm/m², and an acid coated on at least the inner surface of the sheet so as to form neutral salts on the surface of the filler particles.

6. The smoking article, as defined in claim 5, wherein the acid is selected from the group consisting of citric, malic, lactic, glycolic, tartaric, fumaric, maleic, malonic, glutaric, adipic, and succinic acid.

7. The smoking article, as defined in claim 6, wherein the acid is applied by a printing process and the acid is dissolved in an anhydrous solvent.

8. The smoking article, as defined in claim 7, wherein the acid is applied from a solution thereof.

9. A method of improving the taste characteristics of smoking articles wherein a tobacco charge is wrapped in a cellulosic sheet having basic filler concentrations in the range of 14 to 60 gm/m² and applying an acid on at least the inner surface of the sheet so as to form neutral salts on the surface of the filler particles.

10. The method, as defined in claim 9, wherein the acid is selected from the group consisting of citric, malic, lactic, glycolic, tartaric, fumaric, maleic, malonic, glutaric, adipic, and succinic acid.

11. The method, as defined in claim 10, wherein the acid is applied by a printing process and the acid is dissolved in an anhydrous solvent.

12. The method, as defined in claim 10, wherein the acid is applied from a solution thereof.

* * * * *